United States Patent [19]

Jennings, Jr. et al.

[11] 4,143,835

[45] Mar. 13, 1979

[54] MISSILE SYSTEM USING LASER ILLUMINATOR

[75] Inventors: Walter B. Jennings, Jr.; William B. McKnight; Richard D. Milton, all of Huntsville, Ala.

[73] Assignee: The United States of America as represented by the Secretary of the Army, Washington, D.C.

[21] Appl. No.: 714,452

[22] Filed: Aug. 16, 1976

Related U.S. Application Data

[63] Continuation of Ser. No. 288,455, Sep. 12, 1972, abandoned, which is a continuation of Ser. No. 871,746, Oct. 9, 1969, abandoned, which is a continuation of Ser. No. 516,160, Dec. 23, 1965, abandoned.

[51] Int. Cl.[2] ..... F41G 7/14; F42B 13/30; F42B 15/10; F42B 15/02

[52] U.S. Cl. ..... 244/311; 244/316

[58] Field of Search ..... 244/3.11, 3.16

[56] References Cited

U.S. PATENT DOCUMENTS

| | | | |
|---|---|---|---|
| 2,557,401 | 6/1951 | Agins et al. | 244/3.16 |
| 2,969,018 | 1/1961 | Erst | 102/50 |
| 3,239,674 | 3/1966 | Aroyan | 244/3.16 |
| 3,306,206 | 2/1967 | Grantham | 244/3.16 |
| 3,366,346 | 1/1968 | McKnight et al. | 244/3.16 |

FOREIGN PATENT DOCUMENTS

| | | | |
|---|---|---|---|
| 957235 | 5/1964 | United Kingdom | 331/94.5 |

OTHER PUBLICATIONS

Sperry Engineering Review, "Pulsed Optical Lasar Radar", pp. 44 to 53 inclusive.

Aviation Week and Space Technology, "Avionics", May 31, 1965, pp. 39, 43, 47, 49, 50 and 55.

*Primary Examiner*—Samuel W. Engle
*Assistant Examiner*—Thomas H. Webb
*Attorney, Agent, or Firm*—Nathan Edelberg; Robert P. Gibson; James T. Deaton

[57] ABSTRACT

A system for intercepting a target with a missile having semi-active homing guidance. The target is discretely illuminated by a laser beam and the missile homes on the reflected illumination from the target.

5 Claims, 1 Drawing Figure

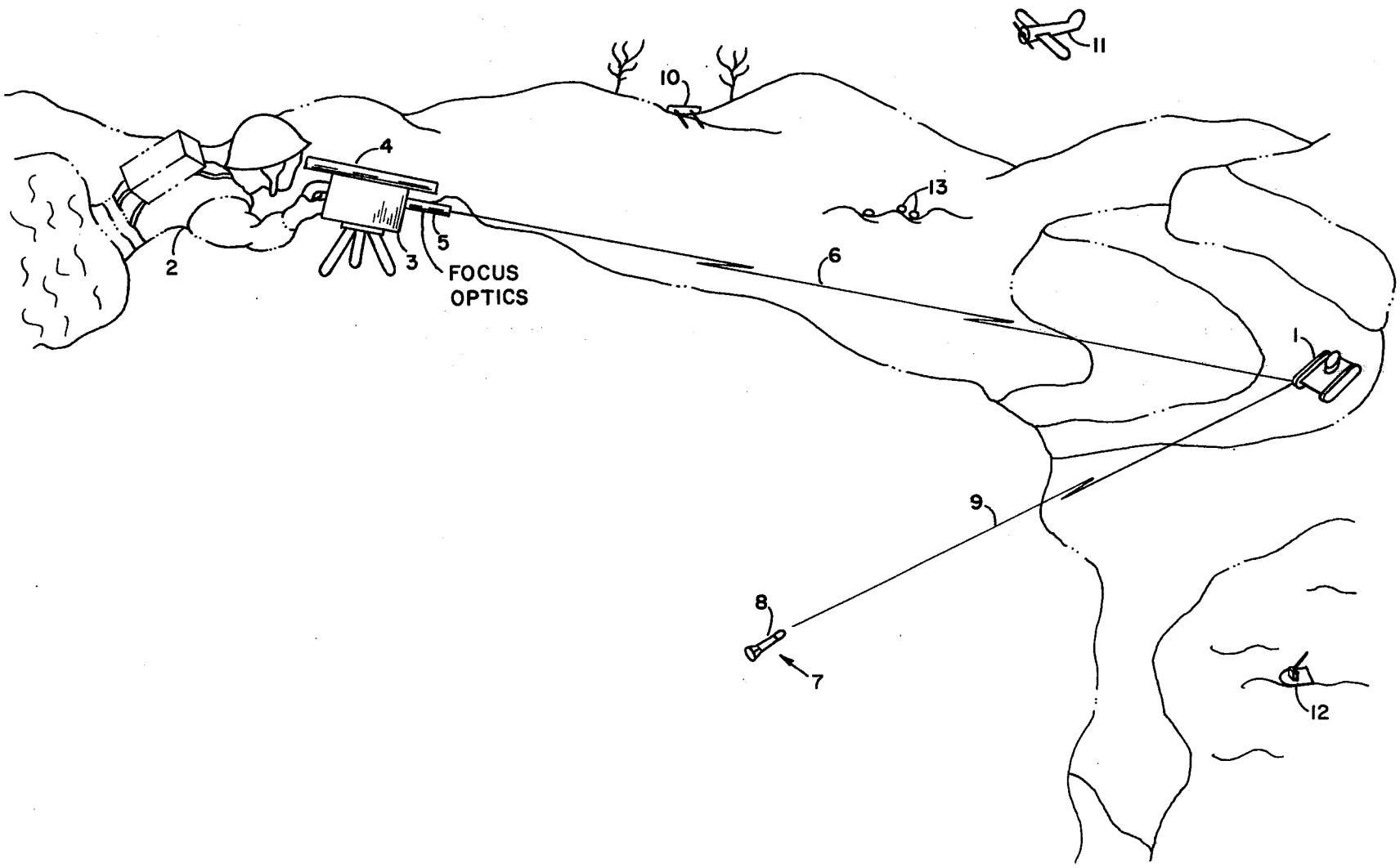
FOCUS
OPTICS
1
2
3
4
5
6
7
8
9
10
11
12
13

MISSILE SYSTEM USING LASER ILLUMINATOR

DEDICATORY CLAUSE

The invention described herein may be manufactured or used by or for the Government for governmental purposes without the payment to us of any royalties thereon.

CROSS REFERENCE TO RELATED APPLICATIONS

This application is a continuation of application Ser. No. 288,455, filed Sept. 12, 1972, which was in turn a continuation of application Ser. No. 871,746, filed Oct. 9, 1969, which was in turn a continuation of application Ser. No. 516,160, filed Dec. 23, 1965 all abandoned.

BACKGROUND OF THE INVENTION

The use of semi-active homing guidance for a missile, of itself, is known. A radar beam is usually employed as the target illuminator and the missile homes on the reflected illumination from said radar beam. A radar illuminator suffers from weight and complexity disadvantages and is not readily adaptable to being carried and operated by a single man. The present invention uses a compact, portable laser illuminator which could be carried and operated by a single man.

There are known missile guidance systems which can be carried by a single man such as the Redeye missile, which uses a man carried optical target tracking telescope with an infrared homing-all-the-way guidance system on the missile. Another type of guidance system that can be man carried is that used by Entac, which uses a missile command-guided over trailing wires by means of a manually operated "joy-stick" control box. The missile, itself, can be transported separately from the control box.

The Redeye missile is used against aircraft and could not effectively track land targets because of the infrared radiation clutter from the ground. The Entac missile has the disadvantage of using trailing wires and could not be used effectively against aircraft.

The invention does not rely upon radiation from the target and does not employ trailing wires or other command links and can be effective against air or ground targets.

Another object of the invention is to provide a system for intercepting a target by using a missile homing on reflected laser illumination of the target.

BRIEF DESCRIPTION OF THE DRAWING

The invention may be best understood by reference to the drawing, which shows the missile system according to this invention.

DESCRIPTION OF THE PREFERRED EMBODIMENT

In the drawing, numeral 1 designates a tank whose destruction is desired. An operator 2 has a laser generator 3, which provides a coherent light beam, with a telescope 4 mounted thereon. Optics 5 focus the laser illumination into a narrow collimated, coherent light beam 6, with which the operator illuminates the target tank (by sighting through telescope 4). A missile 7 is fired from a launcher (not shown) and, through a detector in its forward portion 8, receives reflected illumination 9 from target 1. The missile homes on such reflected illumination intercepts and destroys the target.

Narrow collimated beam 6 has a small cross sectional area with respect to the area of the target to discretely illuminate the target.

While the invention has thus far shown interception and destruction of a land vehicle, other types of targets may be destroyed in accord with the invention. The operator 2 could direct the beam of his laser illuminator on targets such as gun emplacement 10, aircraft 11, ship 12, or men 13 and the missile would home on such targets.

The laser illumination could either be visible or infrared radiation, as desired. Obviously, missile 7 would need the proper detector in accord with the illuminating radiation used. Said missile could be of any desired configuration, such as high explosive, antipersonnel, armor piercing, etc., with a contact, magnetic proximity, or any desired fusing. The launcher for missile 7 could be adjacent operator 2 or could be located away from the operator but so located that missile 7 would be able to detect the reflected target illumination after launching. An example of a form that missile 7 could take is the missile as shown in U.S. Pat. No. 2,969,018 of Jan. 24, 1961, to S. J. Erst et al. Laser illuminator 3 could take any one of various forms, such as those forms shown in British Patent Specification No. 957,235 of May 6, 1964 and in *Sperry Engineering Review,* Winter 1962 (pp. 44–53).

While a specific embodiment of the invention has been described, other embodiments may be obvious to one skilled in the art in light of this description. The laser illuminator could obviously be vehicle carried, if desired, and would find use in helicopters or other aircrafts, land vehicles including ground effect machines, and watercraft.

We claim:

1. A method of operating a missile system having a laser illuminator for illuminating a target with laser beam and a guided missile with detector means capable of detecting reflected laser energy, and disposed for causing the missile to home on a target, the improvement comprising the steps of: discretely illuminating the target in a cluttered field of view with a collimated, coherent light beam of small cross sectional area with respect to the area of the target with laser illumination from the laser illuminator to provide reflection of said laser illumination from said target and in range of the guided missile; and homing the guided missile on said reflected laser illumination from the target for target interception and destruction.

2. A method of operating a man portable missile system having a laser illuminator for illuminating a target with laser beam and a guided missile with detector means capable of detecting reflected laser energy, and disposed for causing the missile to home on a target, the improvement comprising the steps of: discretely illuminating the target in a cluttered field of view with a collimated, coherent light beam of small cross sectional area with respect to the area of the target with laser illumination from the laser illuminator to provide reflection of said laser illumination from said target and in range of the guided missile; and homing the guided missile on said reflected laser illumination from the target for target interception and destruction.

3. The method as defined in claim 1 wherein said laser illumination energy is infrared wavelength energy.

4. The method as defined in claim 2 wherein said laser illumination energy is infrared wavelength energy.

5. A method of operating a guided missile for intercepting a target in a cluttered field of view comprising the steps of: discretely illuminating a target in a cluttered field of view with laser illumination of small cross sectional area with respect to the area of the target; detecting reflected laser illumination from the target, and homing the guided missile when within range of said reflected laser illumination with detector within the missile that is capable of detecting said reflected laser illumination to cause guidance of the missile to thereby home on the target and intercept the target for destruction thereof.

* * * * *